US010600315B2

(12) United States Patent
Kelly

(10) Patent No.: US 10,600,315 B2
(45) Date of Patent: Mar. 24, 2020

(54) MESH NETWORK ENABLED BUILDING SAFETY SYSTEM AND METHOD

(76) Inventor: Chris Kelly, Wayne, NJ (US)

( * ) Notice: Subject to any disclaimer, the term of this patent is extended or adjusted under 35 U.S.C. 154(b) by 0 days.

(21) Appl. No.: 12/383,304

(22) Filed: Mar. 23, 2009

(65) Prior Publication Data

US 2010/0238018 A1 Sep. 23, 2010

(51) Int. Cl.

| | |
|---|---|
| ***G08B 27/00*** | (2006.01) |
| ***G08B 25/14*** | (2006.01) |
| ***G08B 17/10*** | (2006.01) |
| ***G08B 25/10*** | (2006.01) |
| ***G08B 25/08*** | (2006.01) |

(52) U.S. Cl.

CPC ..... *G08B 25/14* (2013.01); *G08B 17/10* (2013.01); *G08B 25/08* (2013.01); *G08B 25/10* (2013.01)

(58) Field of Classification Search

CPC ..... G08B 23/00; G08B 25/14; G08B 25/10; G08B 17/00; G08B 17/06; G08B 17/10; G08B 21/02

USPC ..... 340/517, 584, 628, 632; 455/13.1, 11.1, 455/11.7

See application file for complete search history.

(56) References Cited

U.S. PATENT DOCUMENTS

| | | | | |
|---|---|---|---|---|
| 4,991,123 | A * | 2/1991 | Casamassima | 340/525 |
| 7,415,242 | B1 * | 8/2008 | Ngan | 455/11.1 |
| 7,619,538 | B1 * | 11/2009 | Zarian | 340/815.4 |
| 7,676,195 | B2 * | 3/2010 | Ratiu et al. | 455/13.1 |
| 7,818,037 | B2 * | 10/2010 | Lair et al. | 455/575.2 |
| 7,890,483 | B1 * | 2/2011 | Aaron | H04L 67/12 340/526 |
| 8,055,276 | B2 * | 11/2011 | Otto | 455/456.4 |
| 8,126,442 | B2 * | 2/2012 | Wolfe | 455/414.4 |
| 2003/0052770 | A1 * | 3/2003 | Mansfield et al. | 340/310.01 |
| 2005/0116830 | A1 * | 6/2005 | Wallenstein | 340/628 |
| 2006/0291657 | A1 * | 12/2006 | Benson | G05B 13/0275 380/270 |
| 2007/0106126 | A1 * | 5/2007 | Mannheimer | A61B 5/14551 600/300 |
| 2007/0200914 | A1 * | 8/2007 | DuMas et al. | 348/14.01 |
| 2008/0299899 | A1 * | 12/2008 | Wolfe | H04B 1/3805 455/15 |
| 2009/0243836 | A1 * | 10/2009 | McSheffrey | 340/524 |
| 2010/0164732 | A1 * | 7/2010 | Wedig et al. | 340/577 |

* cited by examiner

*Primary Examiner* — Hongmin Fan

(74) *Attorney, Agent, or Firm* — Gerald Hespos; Michael J. Porco; Adam Hotzoglou

(57) ABSTRACT

A building safety alarm system comprising: a central controller having a dynamically addressable wireless data communication router, a plurality of remote devices each having a dynamically addressable wireless communication router and a wireless mesh communications network wherein the central controller is in wireless communication with the plurality of remote devices via a mesh network for sending and receiving instructions and data communications.

21 Claims, 3 Drawing Sheets

MESH NETWORK ENABLED BUILDING SAFETY SYSTEM AND METHOD

FIELD OF THE INVENTION

The present invention relates to alarm systems and, more particularly, to the means and methods for transmission of information between components within the system architecture. The present invention generally relates to a building fire alarm evacuation system for alerting individuals within a protected area of the presence of an emergency situation. More particularly, the present invention relates to the method of communication between the various equipment locations within a structure and the controller/processor equipment.

STATEMENT OF THE PROBLEM

Fire alarm systems used in buildings and such are designed to save lives and comprise a number of components including devices such as smoke and heat sensors, and audible and visible indicators. Most fire alarm systems of the prior art utilize a physical means to transmit information between components including electrical and optical media. These physical communications paths are subject to attack from and degradation by fire and other physical threats. These links are especially critical in special occupancies including high rise structures which require the system to operate during and after the emergency as total evacuation of the structure is not employed. In these special occupancies buildings, occupants are typically relocated to other floors. The overall fault tolerance of the system is dependent on the ability of the system to communicate with peripheral detection and control equipment at all times, especially during an emergency.

SUMMARY OF THE INVENTION

Therefore, there is a need for a fire alarm system, which incorporates technologies which afford additional fault tolerance and performance during an emergency. Broadly, the present invention provides for replacement of the physical media with a radio frequency based mesh network. This solution would provide for a multi path fully redundant path for critical communications between system components. In the event multiple components of the system were compromised by a physical impairment (fire, explosive blast) the mesh network protocol would transparently reroute communications through an alternate path to maintain full functionality with any surviving system components.

Thus, the present invention in one embodiment provides a building safety alarm system comprising: a central controller having a dynamically addressable wireless data communication router, a plurality of remote devices each having a dynamically addressable wireless communication router and a wireless mesh communications network wherein the central controller is in wireless communication with the plurality of remote devices via a mesh network for sending and receiving instructions and data communications.

In another embodiment, the present invention provides a building safety method operative in a building safety system, through a central building safety system controller and a plurality of remote devices the method comprising the steps of configuring the central building safety system controller, deploying a plurality of remote devices within a structure for providing building safety monitoring services, providing data communications between the central building safety system controller and the remote devices via a dynamically addressable mesh network; and transferring data between the central fire alarm system controller and the plurality of remote devices via the dynamically addressable wireless data communication network.

DESCRIPTION OF THE DRAWINGS

The same reference number represents the same element or same type of element on all drawings.

DETAILED DESCRIPTION OF THE INVENTION

Overall System Architecture

Figure 1:
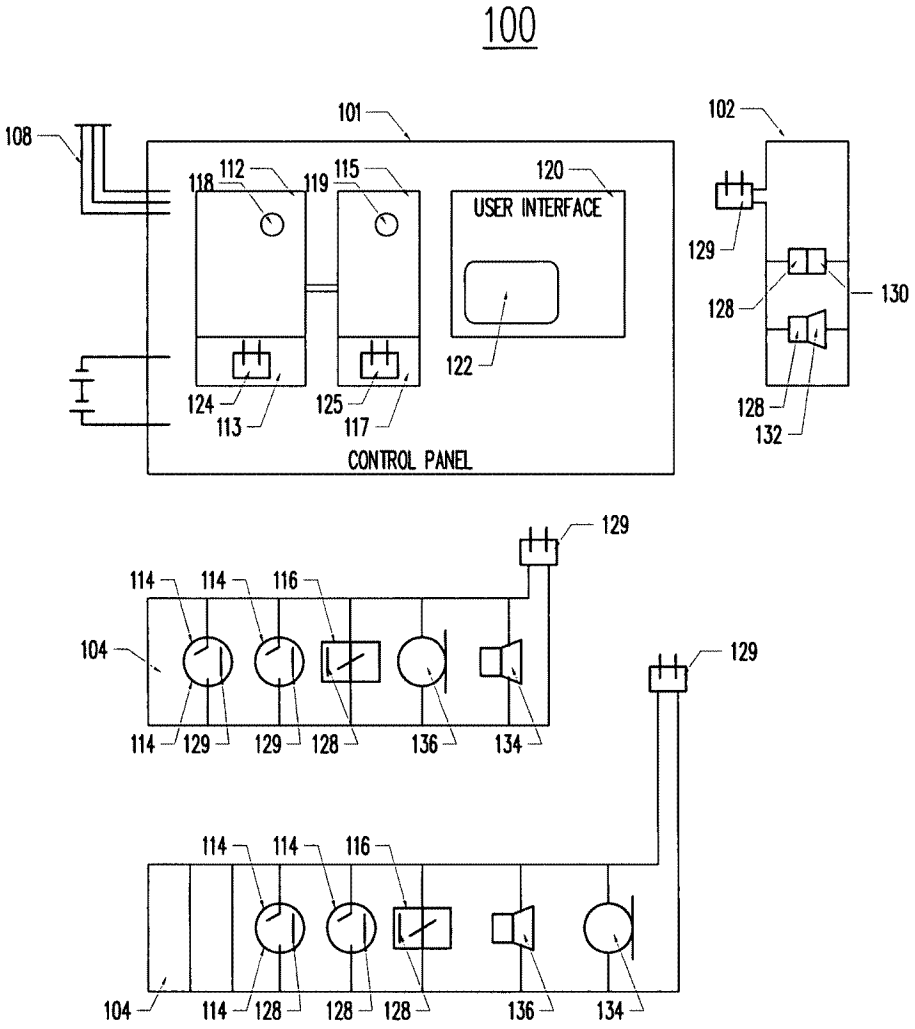
FIG. 1 illustrates a diagrammatic view of a building safety alarm system according to the present invention.

Referring initially to FIG. 1, illustrated therein is an overall diagrammatic view of a building safety alarm system 100 according to the present invention. Such an alarm system may be an addressable panel having a number of loops, where a number of devices are able to be connected, each with its own address. Loop devices may have a plurality of sensors and alarm devices connected and may also have multiple loops on one system. The building safety alarm system in FIG. 1 is depicted as building fire alarm system in this exemplary description. It should be noted however that the descriptions of this exemplary embodiment might be applied to other building safety systems. The system according to FIG. 1 includes a control panel 101 connected to an alarm circuit 102 and sensor or zone circuits 104 and 106. If should be noted that while only two sensor circuits are depicted for ease of description, in application a fire warning system may include many such sensor or zone circuits. Additionally the control panel 101 is connected to a power source 108 and a battery backup 110.

The control panel includes a computer controller 112. The controller 112 coordinates the functioning of the units or modules of the security control panel 100 and connected devices. Computer controller 112 may include an integrated circuit, such as a chip to execute software modules for the functioning of the sensors and alarm devices described hereinafter. Computer controller 112 and the sensors and alarm devices of the safety alarm system 100 may be configured as hardware, software, firmware, or some combination of the foregoing. Computer controller 112 may include a signal processor 113, that receives and transmits electrical or radio signals to the sensors and alarm devices of the various zones. Signal processor 113 may connect to a data network embodying the safety system via a wired and wireless mesh network connection. In accordance with the present invention signal processor 113 may include a processor for receiving data via a wired connection as well as a wireless mesh network router node 124.

In accordance with the present invention, control panel 101 further includes a redundant backup control computer 115, which includes a signal processor circuit 117 with mesh router node 125 and memory 119. A common bus 126 for exchanging and synchronizing information between control computers 112 and 115 connects control computer 112 and redundant backup control computer 115. The bus may be of any industry standard bus protocols for exchanging information between processors and may include either an internal bus or external bus utilizing any one of the protocols known to one skilled in the art.

A memory 118 and 119 connected via a local bus to computer controllers 112 and 115 respectively stores information and settings about the control computer operation and configuration as well as sensor and alarm zones and the safety system 100. For example, memory 118 and 119 may store a computer software operating system and computer controller software comprising instructions for the operation of computer controllers 112 and 115, control panel 101 and the building safety system 100. Memory 118 and 119 may also store information about whether a fault or alarm condition has occurred in a particular zone.

The safety system 100 further includes a user interface 120. The user interface 120 may include key inputs to input commands to computer controller 112, and to request reports or information from control panel 101. Key inputs may include keypads, as well as knobs, buttons, electronic scroll pads, track pads, or the like. The key may also include or be embodied as a full size keyboard, or as a mobile keypad that may be attached to and detached from the user interface as necessary by the user. Reports or information may be provided by computer controller 112 using display screen 122 of user interface 120.

The building safety alarm system 100 according to the present invention further includes sensor or zone circuits 104 and 106. These circuits may include devices such as heat, fire, smoke and carbon monoxide detectors 114 and or call boxes 116. A sensor circuit may also be a normally open loop 104 or may be a normally closed loop 106. A normally open loop senses a fault when an open circuit is closed and a normally closed loop senses a fault when a closed circuit is opened. Sensors adapted to either type of loop are utilized on each type of respective loop. Sensor or zone circuits provide data by signals to signal processor 113. The data may include fault information. A fault may comprise the detection of heat, smoke or carbon monoxide by a sensor 114 or may further include an interaction by a user at a keypad user interface, or call box 116, thus triggering an alarm condition. In addition to sensors 114 and call boxes 116, each circuit may also include a communications device such as microphone 134 and speaker 136 connected to a transceiver for providing a communications means for fire rescue responders. Such a communications device may be embodied in a microphone 134 and speaker 136 node that is connected via the wireless mesh network to control panel 101 or may also include other devices, such as for example a Bluetooth repeater for implementing data transfer from a Bluetooth communications device carried by a user, through a mesh node. A Bluetooth repeater may receive Bluetooth communications from an originating Bluetooth enabled device within range, such as a device carried by an emergency responder and then forward the same data to an intended recipient that was outside the range of the originating Bluetooth enabled device. In accordance with the present invention, such a bluetooth repeater may be connected to a mesh network node, which can then forward the bluetooth data, such as voice communication data to control panel 101. Once the voice data is received by control panel 101, it may then me forwarded via other conventional means such as radio, telephone or other voice communication means to other personal. In accordance with the present invention, an emergency responder within a building is thus able to be in continuous communication with outside personal. Likewise, such a communications device may also include an RF repeater for implementing the transfer of radio signals via the wireless mesh network to and from the remote device and control panel 101. As disclosed below, the fire alarm control panel 101 may include an audio expansion card for connecting to audio communication devices such as fire department radios. In the event that RF radio transmission were compromised, a user, such as fire department personnel would be able to connect an audio communication device to the control panel, either directly via a wired jack, or through a wireless repeater and transmit audio signals via the wireless mesh network system of the present invention. In this way for example emergency responders would have the ability to route audio communications to personnel in the building when RF radio transmissions are compromised due to interference or other anomalies.

Other remote devices may include sensors for detecting motion, in order to locate or discern the existence of individuals trapped in a building or to track the progress of emergency responders. Furthermore, a remote device may also include a transponder. Individuals within the building, such as building personnel or emergency responder may be provided with an active RFID transponder with a unique id code, responsive to antennae located in a remote device. When an individual possessing an RFID transponder moves throughout a building the individuals position may be tracked. The location of the individual can then be displayed on a readout such as a visual display screen depicting a building map or floor plan. As an individual with an RFID transponder moves throughout a building and passes or moves in proximity to any one of the antennea remote devices located throughout the building their position may be tracked with respect to each remote device antenna.

Circuit 102 of building alarm system 100 includes warning or alarm devices. These warning or alarm devices may include a strobe light 130 or other such visible warning apparatus and a sounder, siren, bell 132 or other such audible warning apparatus. Alarm devices 130 and 132 are connected to control panel 101 for receiving signals of a fault condition. When a fault condition is indicated control panel 101 activates the alarm device 130 and or 132.

Each sensor and alarm device may be connected to the control panel 101 via both a wired connection and a wireless mesh network. In order to provide connectivity to each sensor contains a radio card and router 128 and functions as a self contained node on a mesh network. Each sensor is by radio card and router 128 in communication, either directly or indirectly across the mesh topology with the base node located at control panel 101. Alternately an entire loop or sensor circuit could be connected to control panel 101 via a radio card and router 129. In accordance with the present invention a typical mesh network known to those skilled in the art may be implemented. Such a mesh network provides for continuous connections and reconfiguration around broken or blocked paths by "hopping" from node to node until the destination is reached. A mesh network whose nodes are all connected to each other is a fully connected network. Mesh networks differ from other networks in that the component parts can all connect to each other via multiple hops, and they generally are not mobile.

Furthermore, a mesh network as utilized in the present invention is self-healing: the network can still operate even when a node breaks down or a connection goes bad. As a result, a very reliable network is formed. A typical mesh network may be established using a variety of data transmission protocols. Common protocols for implementing wireless mesh networks include IEEE 802.11, 802.15 and 802.16. In addition, other techniques and protocols such as frequency agile techniques may be employed. In accordance with the present invention, a mesh network may be established utilizing one of the known protocols whereby each sensor or alarm device includes a wireless mesh network radio card and router device for both receiving and transmitting signals to and from other nodes.

Utilizing digital RF communications via a mesh network possess several advantages over traditional analog methods; digital data is very "clean", or hard to interfere with. Another advantage of digital RF communications is that any errors caused by interference can be flagged by sending a checksum byte. The received checksum byte is compared to the calculated sum of the received bytes by the base station. If the calculated sum does not equal the received checksum, the processor within the base station can flag these data thereby providing redundancy and validation for the information transmitted via the network.

Wireless Mesh Network

Figure 2:
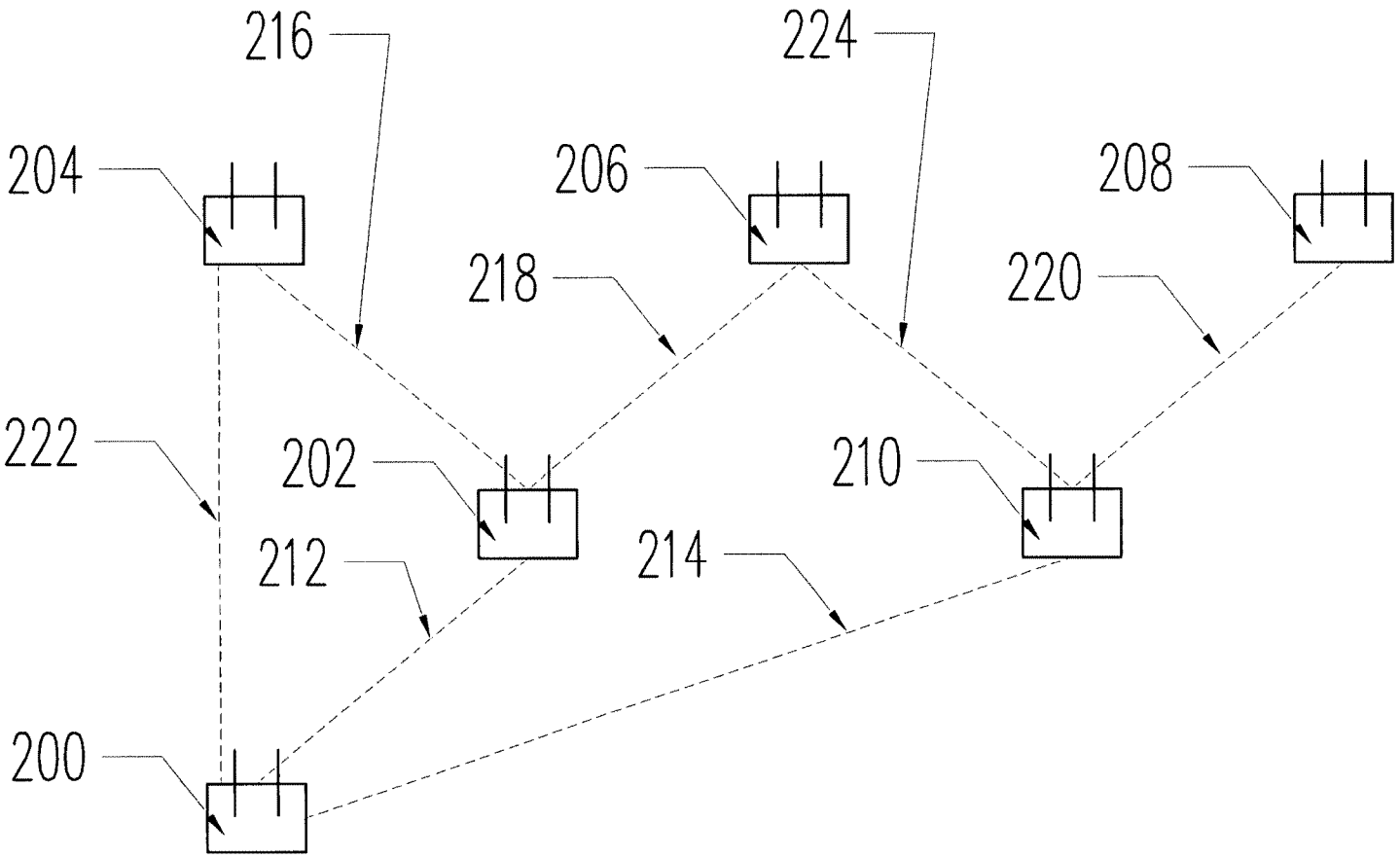
FIG. 2 illustrates a block diagram of a mesh network implementation of the building safety system according to the present invention.

Turning to FIG. 2 there is shown a block diagram of a mesh network implementation of the building safety system 100 according to the present invention. FIG. 2 depicts a plurality of wireless mesh network nodes, representing the control panel node 200, and sensor device nodes 202, 204 and 206. Also shown are alarm device nodes 208. In operation each node 200, 202, 204, 206, 208 and 210 are connected via a dynamically self organized wireless protocol such as for example, 802.11 as disclosed herein. During operation, node 200 may be directly connected via a wireless signal 212 to nodes 202 and to node 210 via wireless signal 214. Node 202 connects to nodes 204 via wireless signal 216 and to node 206 via wireless signal 218. Node 208 is connected to node 210 via wireless signal 220. In this arrangement, each node may function as both a transmitter and receiver of signals. In addition, each node in accordance with mesh networking protocols has the ability to transmit data packets from one node device to another across the mesh topology until the data reaches its destination. This is accomplished by dynamic routing algorithms implemented in each device. To implement such dynamic routing protocols, each device needs to communicate routing information to other devices in the network. Each device then determines what to do with the data it receives either pass it on to the next device or keeps it, depending on the protocol. The routing algorithm used typically attempts to ensure that the data takes the most appropriate (fastest) route to its destination. Therefore, for example if node 202 becomes inoperable, node 200 may connect to node 204 via wireless signal 222. In addition, connectivity to node 206 is maintained through node 210 via wireless signal 224. In this way redundancy and robustness of the system are maintained. In the context of the present invention the dynamic routing protocols of the mesh network are particularly valuable. In a building safety application, the possibility of damage or incapacitation of a particular node, especially during an emergency such as a fire is high, therefore dynamic redundancy of each node is of particular importance. Thus if sensors and or alarm devices are disabled on a particular floor of a building, other floors, for example, those on the floor above the disabled sensors and devices, may still connect to the control panel via alternate and dynamically switched wireless signals.

Computer Controller

Figure 3:
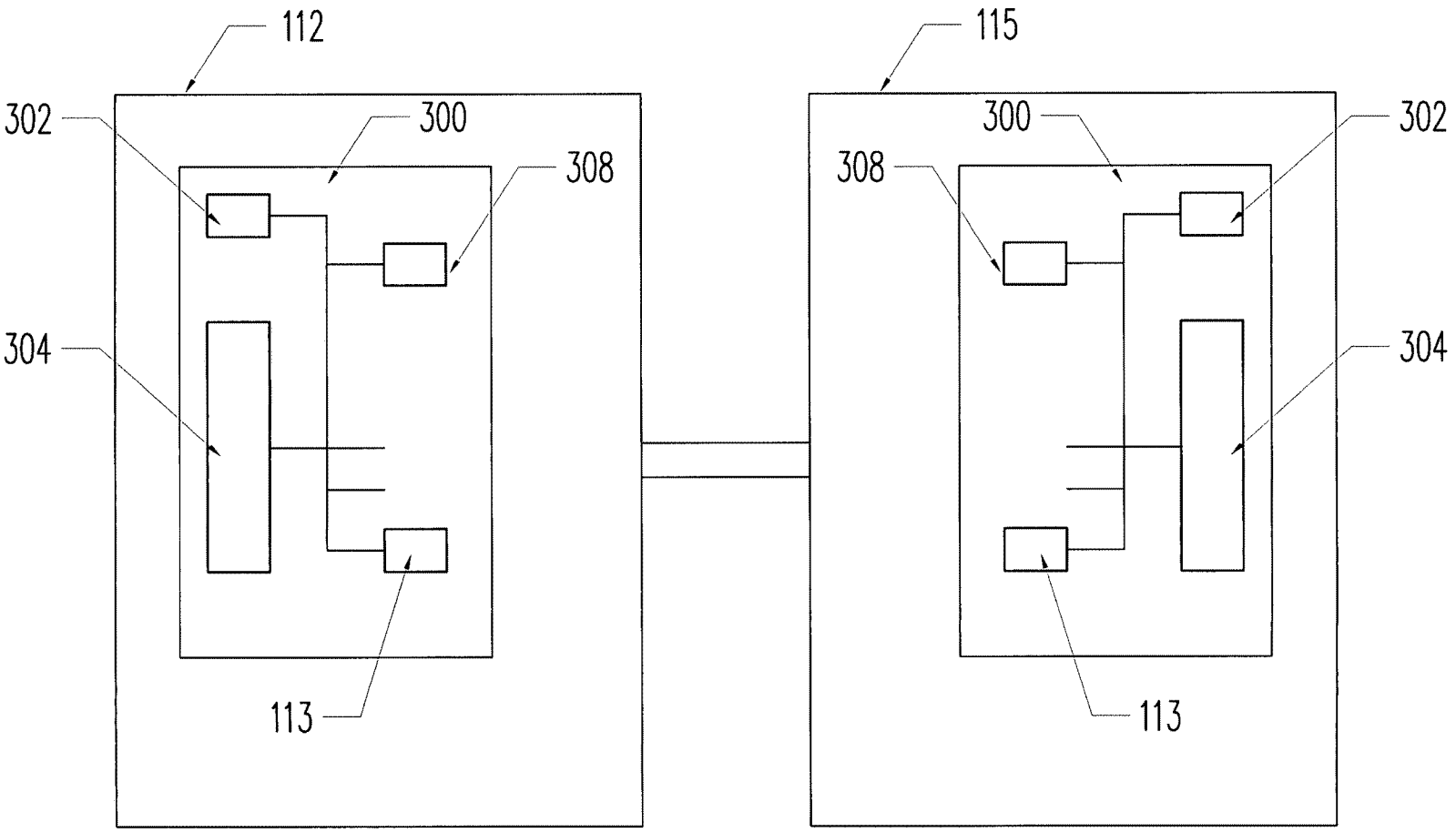
FIG. 3 illustrates a block diagram of a central control computer of the building safety system according to the present invention.

Turning now to FIG. 3, the fire alarm control panel 101 described above includes redundant control computers 112 and 115. Each control computer comprises both hardware and software. The hardware may typically include a motherboard 300, which is the body or mainframe of the computer, through which all other components interface. A central processing unit (CPU) 302 which performs most of the calculations which enable a computer to function.

Random Access Memory (RAM) 304 that is the physical memory of the computer. RAM attaches directly to the motherboard, and is used to store programs that are currently running. There are further included internal or local Buses 306 which provide connections to various internal components such as the CPU, memory and other components such as a signal-processing unit 113. Such buses may include PCI, PCI-E, ISA, USB and other such data transmission bus protocols. For transmitting data externally, there are also included external bus controllers 308 used to connect to external peripherals, such as printers and input devices. These ports may also be based upon expansion cards, attached to the internal buses. For example there may be included an audio input/output provided via an audio expansion card for accepting connectivity to an audio device such as a radio or radio signal repeater to facilitate the transmission of an audio signal through the wireless mesh network into a building in the event that RF signals are compromised.

Controller Software

The control computer 112 and 115 further include software, which may comprise an operating system for providing basic operating instructions to the control computers 112 and 115. The control computers 112 and 115 execute and run executable and custom software configuration, which resides in the primary control computer in non-volatile memory 118 and 119 and utilizes a fully functional shadow copy of said software. This configuration is installed such that changes and modifications to the "software" is conducted on the shadow copy and does not interfere with the operation of the system and provides continuous protection to the area of protection. The shadow backup and mirror software may be maintained utilizing any of the typical methods known in the art for maintaining dynamic mirror copies of software. The fire alarm control panel 101 thus has the capability of a fully redundant processor and control computer 112 and 115 that monitors the operating controller for fault or failure and automatically assumes all command and control functionality of the failed processor/controller and generates a fault signal to alert attending personnel of the failure and the assumption of system operations.

Although specific embodiments were described herein, the scope of the invention is not limited to those specific embodiments. The scope of the invention is defined by the following claims and any equivalents thereof.

What is claimed is:

1. A building safety alarm system comprising:

a control panel located within a building structure, the control panel including a central controller having a dynamically addressable wireless data communication router and an audio input and output device for electrically connecting to a plurality of audio communications devices for routing audio and data communication into and out of said building structure, a plurality of remote devices located on separate floors within said structure, wherein each of said remote devices includes and is electrically connected to both a safety sensor device and a dynamically addressable wireless communication router for transmitting a constant data signal to and from each of said plurality of remote devices, and a plurality of portable two way audio equipment, wherein each safety sensor is in communication, either directly or indirectly across said wireless mesh communications network with a mesh network base data node located at said central controller and, wherein said wireless mesh communication network utilizes a protocol selected from one of IEEE 802.11 protocol or IEEE 802.15 protocol, wherein each of said remote devices include an RF audio transceiver device for providing automatic and uninterrupted audio communication with said plurality of portable two way audio equipment, where each of said plurality of remote devices are electrically connectable to at least one of said plurality of portable two way audio equipment through said RF audio transceiver device via at least one of a wired or wireless connection for transmitting an audio signal for automatically providing continuous two way real time audio communication between said central controller and each one of said plurality of portable two way audio equipment; and wherein said central controller further includes means for radio and/or telephone communications, the central controller further including a signal processor that receives electrical or radio fault information signals from said safety sensor of each of said remote devices, wherein each of said remote devices include a Bluetooth repeater for receiving Bluetooth data from a Bluetooth communications device carried by a user and transferring the Bluetooth data through a mesh node of said wireless mesh communications network, wherein each of said safety sensor devices provide fault data signals to said signal processor and provide uninterrupted audio communications and a data connection to each of said safety sensor device within said building structure over said constant data signal and said audio signal and is automatically and continuously in wireless communication with each of said plurality of remote devices via said wireless mesh communications network for sending and receiving two way voice and data communications, wherein, the control panel further includes a fully redundant backup controller including a dynamically addressable wireless data communication router and an audio output device, the backup controller configured for performing the same functions as the central controller, wherein the backup controller is configured to monitor the central controller for fault or failure and automatically assume all command and control functionality of the central controller within the building safety alarm system and generate a fault signal if a fault or failure of the central controller is detected.

2. The building safety alarm system according to claim 1 wherein said remote devices include heat detectors.

3. The building safety alarm system according to claim 1 wherein said remote devices include fire detectors.

4. The building safety alarm system according to claim 1 wherein said remote devices include smoke detectors.

5. The building safety alarm system according to claim 1 wherein said remote devices include carbon monoxide detectors.

6. The building safety alarm system according to claim 1 wherein said remote devices include call boxes.

7. The building safety alarm system according to claim 1 wherein said remote devices include audio transmission radio repeaters.

8. The building safety alarm system according to claim 1 wherein said remote devices include RFID transponder antenna.

9. The building safety alarm system according to claim 1 wherein said remote devices include motion detectors.

10. The building safety alarm system according to claim 1 wherein said mesh network utilizes an IEEE 802.16 protocol.

11. The building safety alarm system according to claim 1 wherein said mesh network utilizes a frequency agile data transmission protocol.

12. A building safety method operative in a building safety system, through a central building safety system control panel, a plurality of portable two way audio equipment, and a plurality of remote devices, the control panel having a central controller and a fully redundant backup controller, said method comprising the steps of:

locating said central building safety control panel within a building, said central controller including a dynamically addressable wireless data communication router, locating and deploying said plurality of remote devices and a dynamically addressable mesh wireless data communications network within said building for providing building safety monitoring services, wherein each of said remote devices include and is electrically connected to a safety sensor device, a dynamically addressable wireless communication router, an RF audio transmission device for providing continuous and uninterrupted audio communication via a wired or wireless connection for transmitting a radio signal with said plurality of portable audio equipment, and a Bluetooth repeater for receiving Bluetooth data from a Bluetooth communications device carried by a user and transferring the Bluetooth data through a mesh node of the dynamically addressable mesh wireless data communications network, providing continuous data and two way voice communications between said central controller and each of said remote devices via said dynamically addressable mesh wireless data communications network; and providing continuous audio communication between each of said remote devices and each of said plurality of portable audio equipment via a radio signal, and transferring data between the central fire alarm system controller and the plurality of remote devices via said dynamically addressable mesh wireless data communication network, and providing audio communication between each of said remote devices and each of said plurality of portable two way audio equipment through said RF audio transmission device via at least one of wired connection or a wireless radio signal, wherein, the backup controller includes a dynamically addressable wireless data communication router, the backup controller configured for performing the same functions as the central controller, wherein the backup controller is configured to monitor the central controller for fault or failure and automatically assume all command and control functionality of the central controller within the building safety alarm system and generate a fault signal if a fault or failure of the central controller is detected.

13. The building safety method according to claim 12 wherein said dynamically addressable mesh network is self-healing.

14. The building safety method according to claim 12 wherein said remote devices include heat detectors.

15. The building safety method according to claim 12 wherein said remote devices include fire detectors.

16. The building safety method according to claim 12 wherein said remote devices include smoke detectors.

17. The building safety method according to claim 12 wherein said remote devices include carbon monoxide detectors.

18. The building safety method according to claim 12 wherein said remote devices include call boxes.

19. The building safety method according to claim 12 wherein said remote devices include RFID transponder antenna.

20. The building safety method according to claim 12 wherein said remote devices include motion detectors.

21. The building safety method according to claim 12 wherein said mesh network utilizes a frequency agile data transmission protocol.

* * * * *